US009164430B2

(12) United States Patent
Murakami et al.

(10) Patent No.: US 9,164,430 B2
(45) Date of Patent: Oct. 20, 2015

(54) DEVELOPER CONTAINER, DEVELOPING CARTRIDGE, PROCESS CARTRIDGE AND IMAGE FORMING APPARATUS

(71) Applicant: CANON KABUSHIKI KAISHA, Tokyo (JP)

(72) Inventors: Ryuta Murakami, Suntou-gun (JP); Daisuke Makiguchi, Izunokuni (JP); Yoshiyuki Batori, Hiratsuka (JP); Toshiaki Takeuchi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/283,252

(22) Filed: May 21, 2014

(65) Prior Publication Data

US 2014/0348535 A1 Nov. 27, 2014

(30) Foreign Application Priority Data

May 23, 2013 (JP) ..... 2013-108522
Mar. 5, 2014 (JP) ..... 2014-042843

(51) Int. Cl.
*G03G 15/08* (2006.01)

(52) U.S. Cl.
CPC ..... *G03G 15/0882* (2013.01); *G03G 15/0841* (2013.01)

(58) Field of Classification Search
CPC ..... G03G 15/0841; G03G 15/0882; G03G 2215/0687
USPC ..... 399/106, 120
See application file for complete search history.

(56) References Cited

U.S. PATENT DOCUMENTS

| | | | |
|---|---|---|---|
| 5,911,096 | A | 6/1999 | Batori et al. |
| 5,920,753 | A | 7/1999 | Sasaki et al. |
| 5,930,562 | A | 7/1999 | Noda et al. |
| 5,937,237 | A | 8/1999 | Nonaka et al. |
| 5,940,658 | A | 8/1999 | Yokoi et al. |
| 5,953,562 | A | 9/1999 | Kawaguchi et al. |
| 6,075,957 | A | 6/2000 | Batori et al. |
| 6,101,348 | A | 8/2000 | Nonaka et al. |
| 6,131,007 | A | 10/2000 | Yamaguchi et al. |
| 6,275,668 | B1 | 8/2001 | Batori |
| 6,334,035 | B1 | 12/2001 | Abe et al. |
| 6,363,226 | B1 | 3/2002 | Batori |

(Continued)

FOREIGN PATENT DOCUMENTS

JP 05-197288 A 8/1993

*Primary Examiner* — Walter L Lindsay, Jr.
*Assistant Examiner* — Rodney Bonnette
(74) *Attorney, Agent, or Firm* — Fitzpatrick, Cella, Harper & Scinto

(57) ABSTRACT

A developer container includes: a developer chamber, provided with an opening, for accommodating a developer; a rotatable member rotatably supported in the developer chamber; and a sealing member for being removed at the opening by being wound up by the rotatable member, wherein the sealing member is provided in the developer chamber and includes a first end portion connected to the rotatable member and a second end portion sealing the opening. Sealing of the opening is made by bonding the sealing member along an edge of the opening. The developer container includes a first bonding portion provided upstream of the opening and a second bonding portion provided downstream of the opening with respect to an unsealing direction of the sealing member. A peeling-off force for peeling off the sealing member at a predetermined angle is larger at the first bonding portion than at the second bonding portion.

13 Claims, 13 Drawing Sheets

(56) References Cited

U.S. PATENT DOCUMENTS

| | | | | |
|---|---|---|---|---|
| 6,714,746 | B2 | 3/2004 | Morioka et al. | |
| 6,735,405 | B2 | 5/2004 | Yokoi et al. | |
| 6,836,639 | B2 | 12/2004 | Karakama et al. | |
| 6,898,392 | B2 | 5/2005 | Karakama et al. | |
| 6,937,832 | B2 | 8/2005 | Sato et al. | |
| 6,963,706 | B2 | 11/2005 | Morioka et al. | |
| 6,987,938 | B2 | 1/2006 | Murakami et al. | |
| 7,024,131 | B2 | 4/2006 | Komatsu et al. | |
| 7,079,787 | B2 | 7/2006 | Ogino et al. | |
| 7,127,192 | B2 | 10/2006 | Batori et al. | |
| 7,136,604 | B2 | 11/2006 | Chadani et al. | |
| 7,156,797 | B2 | 1/2007 | Komatsu et al. | |
| 7,200,349 | B2 | 4/2007 | Sato et al. | |
| 7,206,534 | B2 | 4/2007 | Murakami | |
| 7,418,225 | B2 | 8/2008 | Morioka et al. | |
| 7,885,575 | B2 | 2/2011 | Batori et al. | |
| 8,081,898 | B2 | 12/2011 | Batori et al. | |
| 8,326,185 | B2 | 12/2012 | Asanuma et al. | |
| 8,406,656 | B2 | 3/2013 | Batori et al. | |
| 8,565,640 | B2 | 10/2013 | Batori et al. | |
| 8,620,181 | B2 | 12/2013 | Murakami | |
| 8,644,732 | B2 | 2/2014 | Kikuchi et al. | |
| 8,676,085 | B1 | 3/2014 | Batori et al. | |
| 2014/0086620 | A1* | 3/2014 | Takeuchi et al. | 399/106 |
| 2014/0086621 | A1* | 3/2014 | Makiguchi et al. | 399/106 |
| 2014/0086632 | A1 | 3/2014 | Batori et al. | |
| 2014/0093272 | A1* | 4/2014 | Matsumaru et al. | 399/106 |
| 2014/0105639 | A1 | 4/2014 | Kikuchi et al. | |
| 2014/0126928 | A1* | 5/2014 | Batori et al. | 399/106 |
| 2014/0212166 | A1* | 7/2014 | Takeuchi et al. | 399/106 |
| 2014/0212180 | A1 | 7/2014 | Nakamura et al. | |
| 2014/0212181 | A1* | 7/2014 | Nakamura et al. | 399/258 |
| 2014/0356020 | A1* | 12/2014 | Murakami et al. | 399/106 |
| 2014/0376955 | A1* | 12/2014 | Takeuchi | 399/106 |
| 2014/0376969 | A1* | 12/2014 | Batori | 399/258 |
| 2015/0003865 | A1* | 1/2015 | Batori et al. | 399/106 |

* cited by examiner (a)

(b)

DEVELOPER CONTAINER, DEVELOPING CARTRIDGE, PROCESS CARTRIDGE AND IMAGE FORMING APPARATUS

FIELD OF THE INVENTION AND RELATED ART

The present invention relates to a developer container, a developing cartridge, a process cartridge and an image forming apparatus including the developer container.

An electrophotographic image forming apparatus forms an image on a recording material, such as a recording sheet or an OHT (overhead transparency) sheet (transparent sheet used for an OHP (overhead projector), by using an electrophotographic type.

Examples of the electrophotographic image forming apparatus may include an electrophotographic copying machine, an electrophotographic printer, a facsimile machine and a multi-function machine (printer) having functions of these machines.

Further, the process cartridge refers to a process cartridge prepared by integrally assembling an electrophotographic photosensitive drum and, as an image forming process means actable on the electrophotographic photosensitive drum, at least one of a charging means, a developing means and a cleaning means into a cartridge. Then, this process cartridge is detachably mounted into a main assembly of the electrophotographic image forming apparatus.

The electrophotographic image forming apparatus using the electrophotographic type forms an electrostatic latent image by subjecting the electrophotographic photosensitive drum uniformly electrically charged by the charging means, to selective exposure to light depending on image information. Then, the electrostatic latent image is developed with a toner by the developing means, so that a toner image is formed. Thereafter, the toner image formed on the electrophotographic photosensitive drum is transferred onto the reading material to effect image formation.

Japanese Laid-Open Patent Application (JP-A) Hei 5-197288 proposes a constitution in which an opening for permitting communication between a toner accommodating chamber and a developing chamber is sealed by using a toner seal member (material), and then the toner seal member is removed by a toner stirring member.

The unsealing of the opening is performed by winding up the toner seal member mounted at an end thereof on the stirring member in the toner accommodating chamber. After the unsealing of the opening, the toner seal member is rotated integrally with the rotatable member.

As a result, it is possible to prevent leakage of the toner caused by vibration or impact during transportation of the process cartridge. The toner seal member remains in the process cartridge, and therefore there is no need for a user to treat the toner seal member. Further, there is no need for the user to remove the toner seal member, and therefore usability (ease of use) is improved.

However, in an attitude such that the opening is positioned in a lower side than the toner accommodating chamber with respect to a direction of gravitation during transportation of the process cartridge, the process cartridge is dropped. Then, the toner seal member is pressed by a weight of the toner, so that a periphery of the opening is deformed. As a result, in the case where tension is applied to the toner seal member and the toner weight is further increased, there is a possibility that the toner seal member is peeled off from the developer container.

SUMMARY OF THE INVENTION

The present invention has solved the above-described problem, and a principal object of the present invention to provide a developer accommodating container capable of preventing peeling-off of a sealing member during transportation or the like.

According to an aspect of the present invention, there is provided a developer container comprising: a developer chamber, provided with an opening, for accommodating a developer; a rotatable member rotatably supported in the developer chamber; and a sealing member for being removed at the opening by being wound up by the rotatable member, wherein the sealing member is provided in the developer chamber and includes a first end portion connected to the rotatable member and a second end portion sealing the opening, wherein sealing of the opening is made by bonding the sealing member along an edge of the opening, wherein the developer container includes a first bonding portion provided upstream of the opening and a second bonding portion provided downstream of the opening with respect to an unsealing direction of the sealing member, and wherein a peeling-off force for peeling off the sealing member at a predetermined angle is larger at the first bonding portion than at the second bonding portion.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

With reference to the drawings, an embodiment of an image forming apparatus including a developer container, a developing cartridge and a process cartridge will be described specifically.

Incidentally, in the following description, a rotational axis direction of a photosensitive drum 62 as an image bearing member for forming a developer image with a developer is referred to as a longitudinal direction.

Further, with respect to the longitudinal direction, a side where the photosensitive drum 62 receives a driving force from a main assembly of an image forming apparatus A is referred to as a driving side (a driving force receiving portion 63*a* side shown in FIG. 4), and its opposite side is referred to as a non-driving side.

<Image Forming Apparatus and Image Forming Process>

First, a general structure of the image forming apparatus A and an image forming process will be described with reference to FIGS. 1 and 3.

Figure 1:
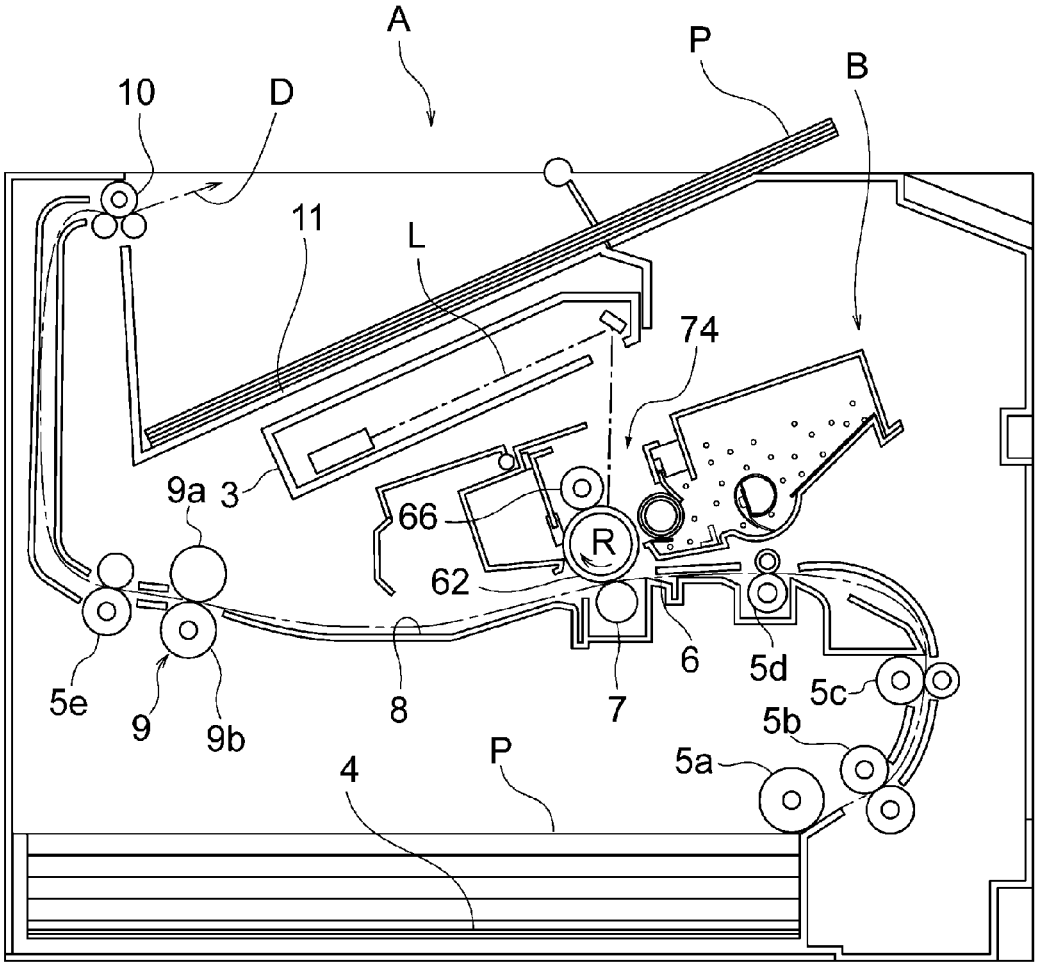
FIG. 1 is a sectional illustration showing a structure of a developer container, a developing cartridge, a process cartridge and an image forming apparatus including the developer container according to the present invention.

FIG. 1 is a sectional view of the image forming apparatus A of an electrophotographic type in this embodiment of the present invention and a process cartridge B constituted as to be detachably mountable to the image forming apparatus A. FIG. 3 is a sectional view of the cartridge B. Here, a main assembly of the image forming apparatus A refers to a portion of the image forming apparatus A from which the cartridge B is removed.

<General Structure of Image Forming Apparatus>

In FIG. 1, the image forming apparatus A for forming an image on a recording material P is a laser beam printer, using an electrophotographic technology, in which the cartridge B is detachably mountable to the main assembly of the image forming apparatus A. When the cartridge B is mounted in the main assembly of the image forming apparatus A, above the process cartridge B in FIG. 1, a laser scanner unit 3 as an exposure means is provided.

Further, below the cartridge B in FIG. 1, a feeding tray 4 in which a recording material P to be subjected to image formation is accommodated is provided. Further, in the main assembly of the image forming apparatus A, along a conveyance (feeding) direction D of the recording material P, a pick-up roller 5*a*, a feeding roller 5*b*, a conveying roller 5*c*, a registration roller 5*d*, a transfer guide 6, a transfer roller 7 as a transfer means and a conveying guide 8 are provided. Further, a fixing device 9, a discharging roller 10, a discharge tray 11 and the like are successively provided. Incidentally, the fixing device 9 is constituted by including a heating roller 9*a* and a pressing roller 9*b*.

<Image Forming Process>

Next, a general constitution on the image forming process will be described. On the basis of a print start signal, the photosensitive drum 62 is rotationally driven at a predetermined peripheral speed (process speed) in an arrow R direction in FIG. 1.

A charging roller 66 as a charging means to which a charging bias voltage is applied contacts the surface of the photosensitive drum 62 and electrically charges the surface of the photosensitive drum 62 uniformly.

The laser scanner unit 3 outputs laser light L depending on image information. The laser light L passes through an exposure window portion 74 provided at an upper surface of the cartridge B in FIG. 1, so that the surface of the photosensitive drum 62 is subjected to scanning exposure. As a result, on the outer peripheral surface of the photosensitive drum 62, an electrostatic latent image depending on the image information is formed.

Figure 3:
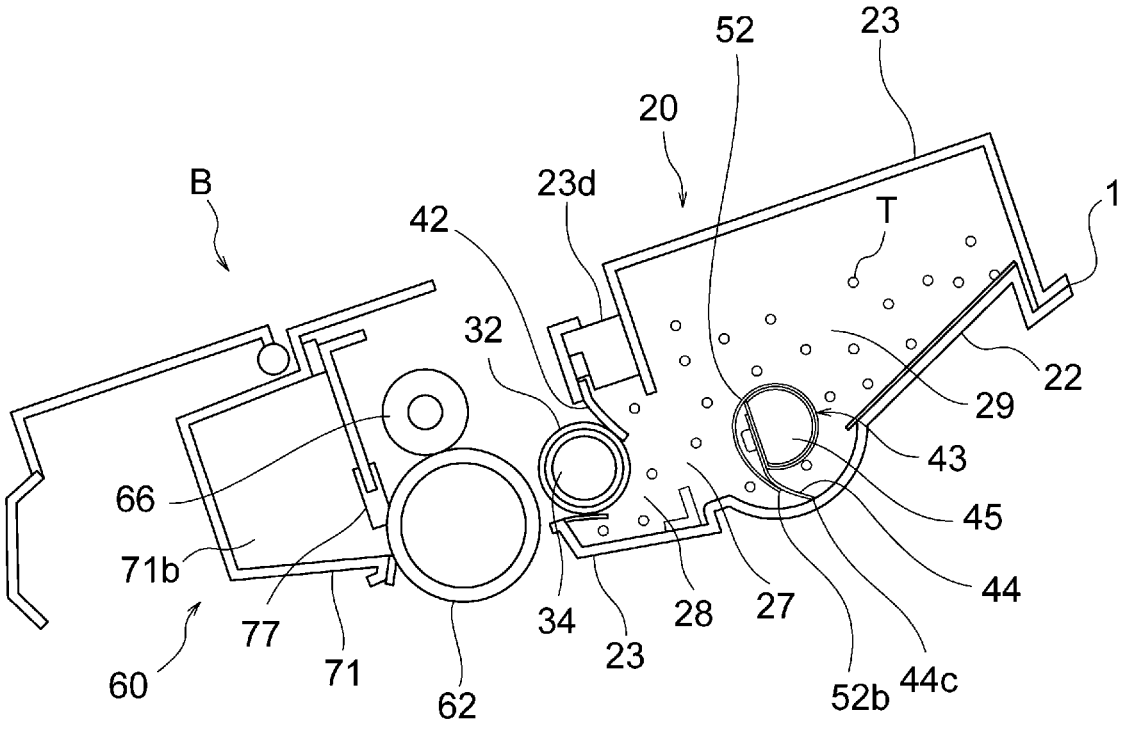
FIG. 3 is a sectional illustration showing the structure of the process cartridge.

On the other hand, as shown in FIG. 3, in a developer accommodating unit 20 as a developing device, a rectangular opening 27 defined by long sides and short sides is provided, and a toner T in a toner chamber 29 as a developer chamber for accommodating the toner T as a developer is stirred and fed by rotation of a feeding member 43. Then, the toner T is sent to a toner supplying chamber 28 in which a developing sleeve 32 as a developer carrying member for supplying the toner to the surface of the electrostatic latent image formed on the surface of the photosensitive drum 62.

The toner is carried on the surface of the developing sleeve 32 by a magnetic force of a magnet roller 34 including a fixed magnet. Further, the toner is subjected to regulation of a layer thickness thereof on the surface of the developing sleeve 32, while being triboelectrically charged, by a developing blade 42 as a developer regulating member for regulating a layer thickness of the developer on the surface of the developing sleeve 32 for supplying the toner T to the surface of the photosensitive drum 62 on which the electrostatic latent image is formed.

The toner T carried on the surface of the developing sleeve 32 is transferred onto the surface of the photosensitive drum 62 depending on the electrostatic latent image formed on the surface of the photosensitive drum 62, so that the electrostatic latent image is visualized as a toner image.

Further, as shown in FIG. 1, in synchronism with output timing of the laser light L, by the pick-up roller 5*a*, the feeding roller 5*b* and the conveying roller 5*c*, the recording material P accommodated in the feeding tray 4 provided at a lower portion of the main assembly of the image forming apparatus A is fed to the registration roller 5*d*.

Then, by the registration roller 5*d*, the recording material P is conveyed, in synchronism with the toner image formed on the surface of the photosensitive drum 62, to a transfer position as a nip formed between the photosensitive drum 62 and the transfer roller 7, via the transfer guide 6. At this transfer position, the toner image is successively transferred from the surface of the photosensitive drum 62 onto the recording material P.

The recording material P on which the toner image is transferred is separated from the photosensitive drum 62 and then is conveyed to the fixing device 9 along the conveying guide 8. Then, the recording material P passes through a nip between the heating roller 9*a* and the pressing roller 9*b* which constitute the fixing device 9.

At this nip, fixing by heating and pressure application are effected, so that the toner image is fixed on the recording material P. The recording material P on which the toner image is fixed is conveyed to the discharging roller 10 by the conveying roller 5*e* and then is discharged onto the discharge tray 11.

On the other hand, as shown in FIG. 3, the surface of the photosensitive drum 62 after the toner image is transferred onto the recording material P is, after from which a residual toner is removed by a cleaning blade 77, used again in the image forming process. The toner T removed from the surface of the photosensitive drum 62 is stored in a residual toner chamber 71*b* of a cleaning unit 60.

In the above-described constitution, the charging roller 66, the developing sleeve 32, and the cleaning blade 77 are the image forming process means actable on the photosensitive drum 62.

<General Structure of Cartridge>

Figure 2:
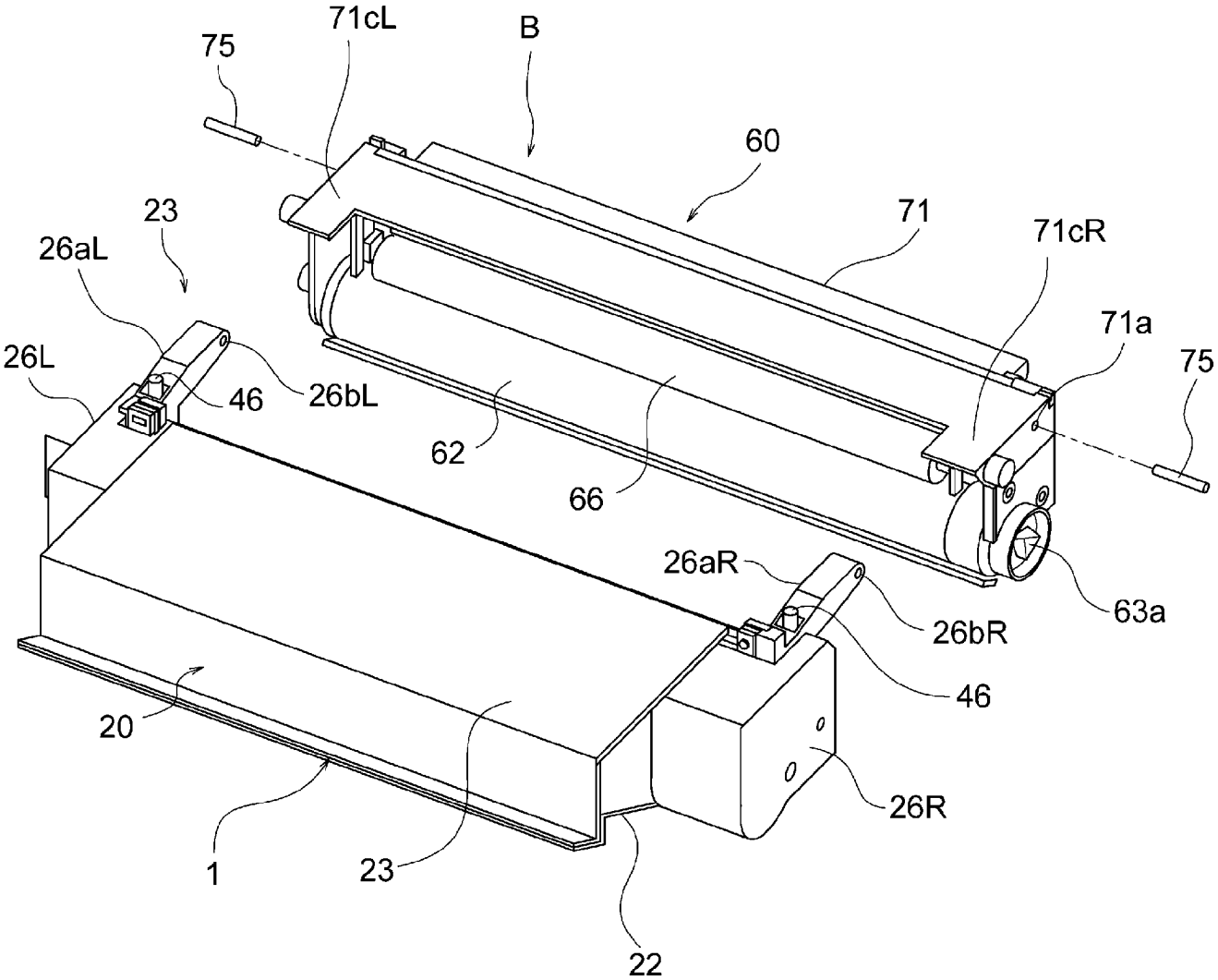
FIG. 2 is an exploded perspective view showing the structure of the process cartridge.

Next, with respect to FIGS. 2 and 3, a general structure of the cartridge B will be described. FIG. 3 is an exploded perspective view for illustrating a structure of the cartridge B. As shown in FIG. 2, the cartridge B is constituted by combining the cleaning unit 60 and the developing unit 20.

The cleaning unit 60 is constituted by including a cleaning frame 71, the photosensitive drum 62, the charging roller 66, the cleaning blade 77 and the like. On the other hand, the developing unit 20 is constituted by including the upper container 23, a bottom member 22, (left and right) side members 26L and 26R, a developing blade 42, the developing sleeve 32, the magnet roller 34, the feeding member 43, the toner T, an urging member 46, and the like.

Then, the cleaning unit 60 and the developing unit 20 are rotationally movably connected to each other by a connecting member 75, so that the cartridge B is constituted.

Specifically, the side members 26L and 26R are provided at end portions of the developing unit 20 with respect to a longitudinal direction of the developing unit 20 (a left-right direction in FIG. 2). Further, arm portions 26*a*L and 26*a*R formed on the side members 26L and 26R, respectively, are provided with rotational movement holes 26*b*L and 26*b*R, respectively at their end portions, in parallel to the developing sleeve 32.

Further, at each of longitudinal end portions of the cleaning frame 71, an engaging hole 71*a* for permitting engagement therein of the pin-like connecting member 75 is formed. Then, the arm portions 26*a*L and 26*a*R are aligned with predetermined positions of the cleaning frame 71, and then the connecting members 75 are inserted into the rotational movement holes 26*b*L and 26*b*R and the engaging holes 71*a*. As a result, the cleaning unit 60 and the developing unit 20 are connected to each other rotatably about the connecting members 75.

At this time, urging members 46 mounted at base portions of the arm portions 26*a*L and 26*a*R abut against abutment portions 71*c*L and 71*c*R provided at longitudinal end portions of the cleaning frame 71, thus urging the developing unit 20, rotatably about the connecting members 75, toward the cleaning unit 60. As a result, the developing sleeve 32 is pressed toward the photosensitive drum 62 with reliability.

Figure 5:
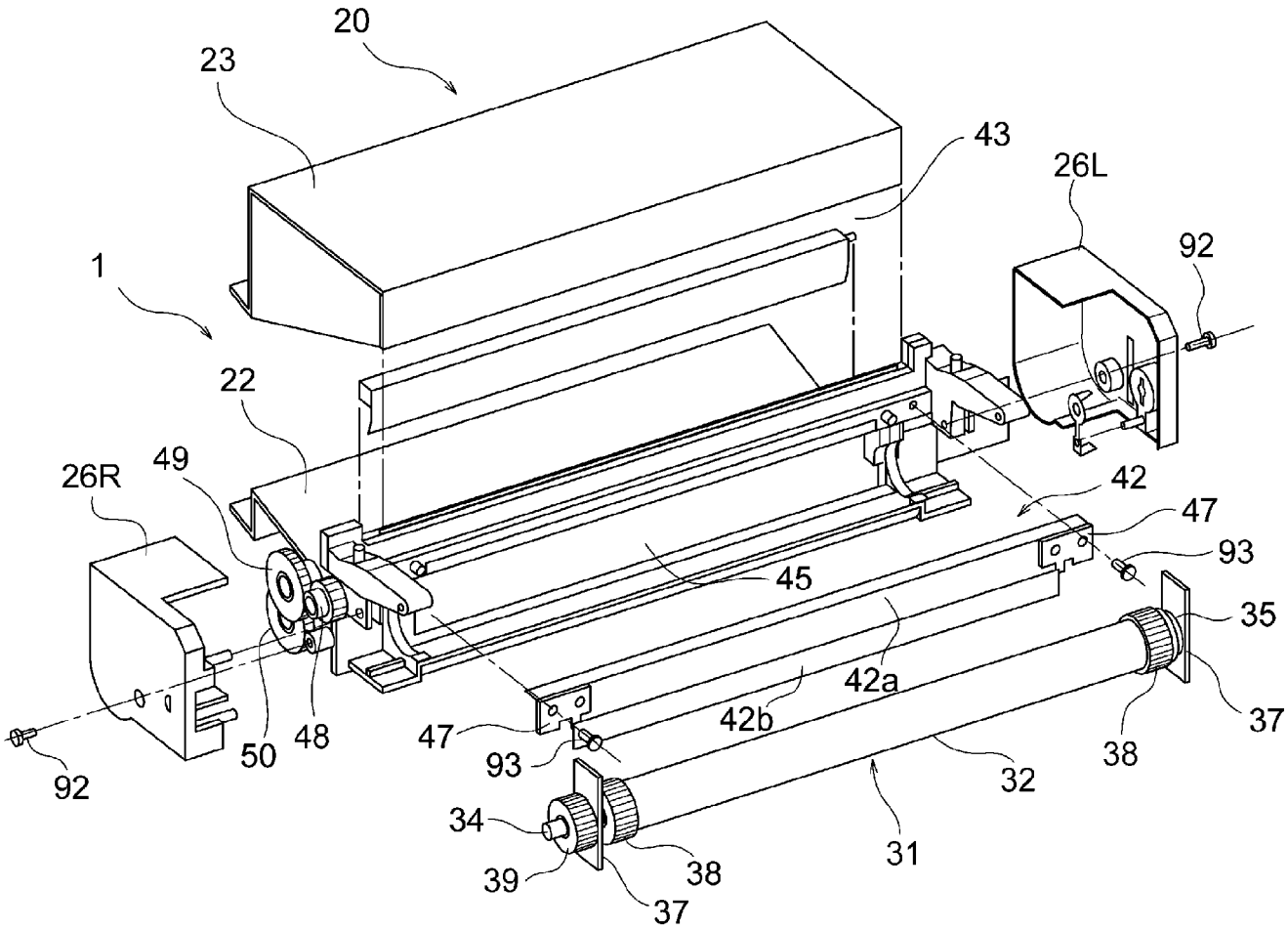
FIG. 5 is an exploded perspective view showing a structure of a developing unit.

Then, by a gap (spacing) holding member 38 mounted at each of the end portions of the developing sleeve 32 with respect to the rotational axis direction of the developing sleeve 32 shown in FIG. 5, the developing sleeve 32 is held with a predetermined gap from the photosensitive drum 62.

<Cleaning Unit>

Figure 4:
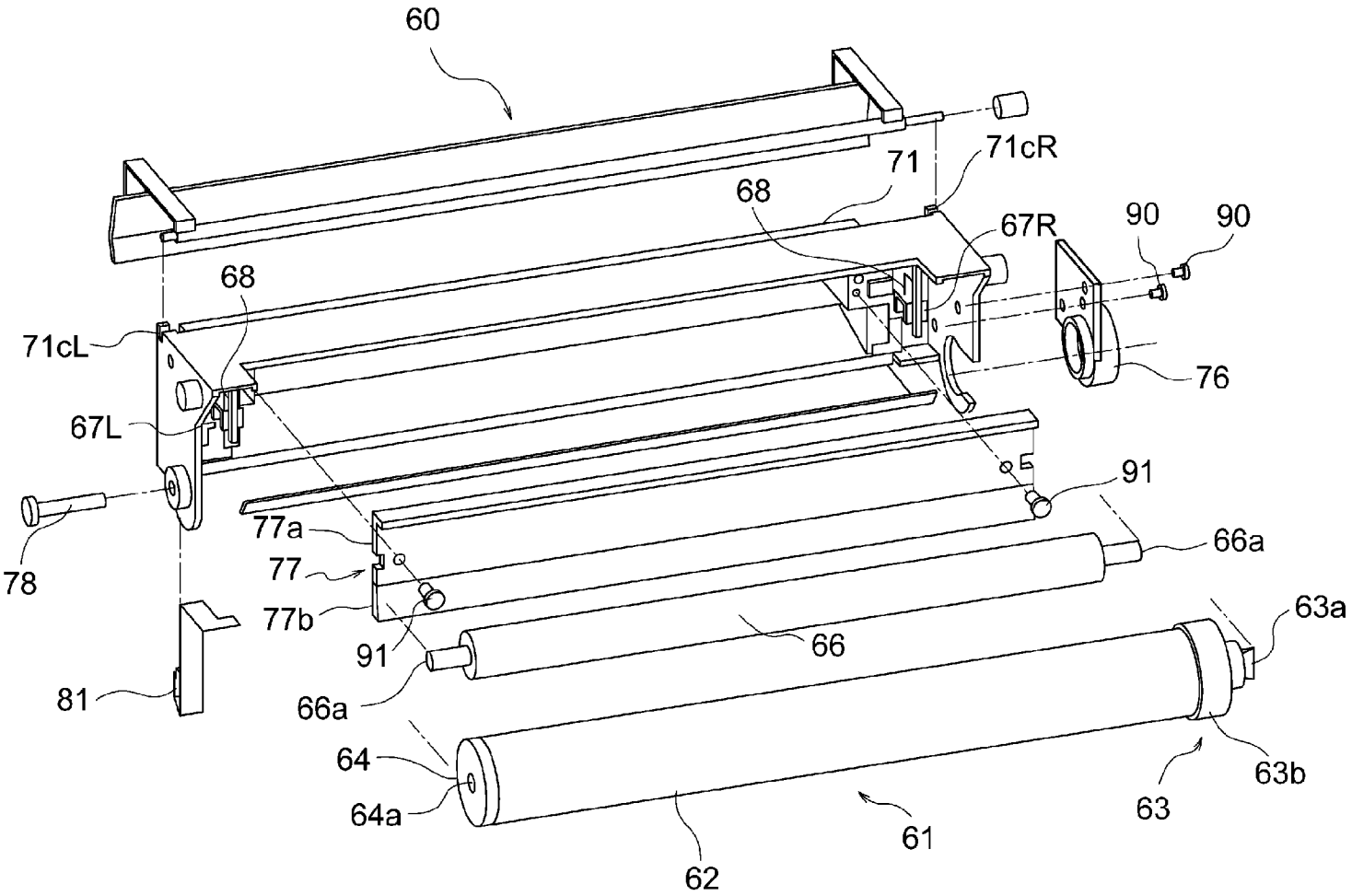
FIG. 4 is an exploded perspective view showing a structure of a cleaning unit.

Next, with reference to FIG. 4, a structure of the cleaning unit 60 will be described. FIG. 4 is an exploded perspective view for illustrating the structure of the cleaning unit 60.

In FIG. 4, the cleaning unit 60 is constituted by including a supporting member 77*a* formed with a metal plate and an elastic member 77*b* formed of an elastic material such as urethane rubber. Further, the cleaning blade 77 is fixed at a predetermined position on the cleaning frame 71 by being fixed with screws 91 at longitudinal end portions of the supporting member 77*a*.

The elastic member 77*b* contacts the surface of the photosensitive drum 62, so that the residual toner is removed from the surface of the photosensitive drum 62.

The removed toner T is stored in the residual toner container 71*b* in the cleaning unit 60 shown in FIG. 3.

An electrode plate 81, an urging member 68 and charging roller bearings 67L and 67R which are shown in FIG. 4 are mounted on the cleaning frame 71. A shaft portion 66*a* of the charging roller 66 is rotatably engaged into the charging roller bearings 67L and 67R.

The charging roller 66 is urged toward the photosensitive drum 62 by the urging member 68, and is rotatably supported by the charging roller bearings 67L and 67R. Then, the charging roller 66 is rotated by rotation of the photosensitive drum 62.

The photosensitive drum 62 is connected integrally with flanges 63 and 64 and thus is constituted as a photosensitive (drum) unit 61. This connecting method can be performed by using caulking, bonding, welding or the like.

To the flange 64, an unshown grounding contact and the like are connected. Further, the flange 63 includes a driving force receiving portion 63*a* for receiving a driving force from the main assembly of the image forming apparatus A and includes a flange gear portion 63*b* for transmitting the driving force to the developing sleeve 32 shown in FIG. 5.

The bearing member 76 shown in FIG. 4 is integrally fixed with a screw 90 on the cleaning frame 71 in the driving side which is the right side in FIG. 4, and the drum shaft 78 is press-fitted and fixed in the cleaning frame 71 in the non-driving side which is the left side in FIG. 4. Further, the bearing member 76 is engaged with the flange 63, and a drum shaft 78 is engaged with a hole 64*a* of the flange 64. As a result, the photosensitive drum unit 61 is rotatably supported by the cleaning frame 71.

<Developing Unit>

Next, a structure of the developing unit 20 as a developer container will be described with reference to FIG. 5. FIG. 5 is an exploded perspective view for illustrating a structure of the developing unit 20. In FIG. 5, a developing (device) frame 1 consisting of the upper container 23 and the bottom member 22 defines the toner chamber 29 in which the toner T is accommodated, and the toner feeding chamber 28 which are shown in FIG. 3. The upper container 23 and the bottom member 22 are integrally connected to each other by welding or the like.

As shown in FIGS. 3 and 5, the feeding member 43 is constituted by including a feeding sheet 44 and the rotatable member 45 rotatably supported in the toner chamber 29 (developing chamber).

The feeding member 43 is rotatably supported by the upper container 23 in the non-driving side shown in the right side of FIG. 5, and is rotatably supported by a feeding gear 50 mounted on the upper container 23 in the driving side shown in the left side of FIG. 5. As a result, the feeding member 43 is rotated in the toner chamber 29 by the rotation of the feeding gear 50.

The developing blade 42 is constituted by including a supporting member 42*a* formed with a metal plate and including an elastic member 42*b* formed of an elastic material such as an urethane rubber, and is fixed together with a cleaning member 47 at a predetermined position relative to the upper container 23 with screws 93 provided at longitudinal end portions of the supporting member 42*a*.

A developing sleeve unit 31 is constituted by including the developing sleeve 32, the magnet roller 34, a flange 35, the gap holding member 38, a bearing member 37, a developing sleeve gear 39 and the like. From an end portion of the developing sleeve 32 in the non-driving side shown in the right side of FIG. 5, the magnet roller 34 is inserted, and at the end portion in the non-driving side, the flange 35 is press-fitted and fixed.

The gap holding member 38 is mounted at each of the end portions of the developing sleeve 32 with respect to the longitudinal direction of the developing sleeve 32. Further, outside the gap holding member 38 with respect to the longitudinal direction of the developing sleeve 32, the bearing member 37 is disposed, and in the driving side shown in the left side of FIG. 5, the developing sleeve gear 39 is assembled outside the bearing member 37 with respect to the longitudinal direction of the developing sleeve 32. By the bearing member 37 disposed at each of the end portions of the developing sleeve 32 with respect to the longitudinal direction of the developing sleeve 32, the developing sleeve 32 is rotatably supported.

Gears 48 and 49 as a drive transmission member are rotatably engaged with the developing frame 1. As a result, the driving force received from the main assembly of the image forming apparatus A is transmitted to the developing sleeve 32 and the feeding member 43 by successive engagement and rotation of a flange gear portion 63*b* shown in FIG. 4 and of the developing sleeve gear 39, the gears 48 and 49, and the feeding gear 50 which are shown in FIG. 5.

The side members 26L and 26R are fixed with screws 92 at end portions, respectively, of the developing frame 1 of the developing unit 20 with respect to the longitudinal direction of the developing frame 1. At that time, the bearing members 37 of the developing sleeve unit 31 are held by the side members 26L and 26R.

<Structure and Removing Operation of Toner Sealing Member>

Figure 6:
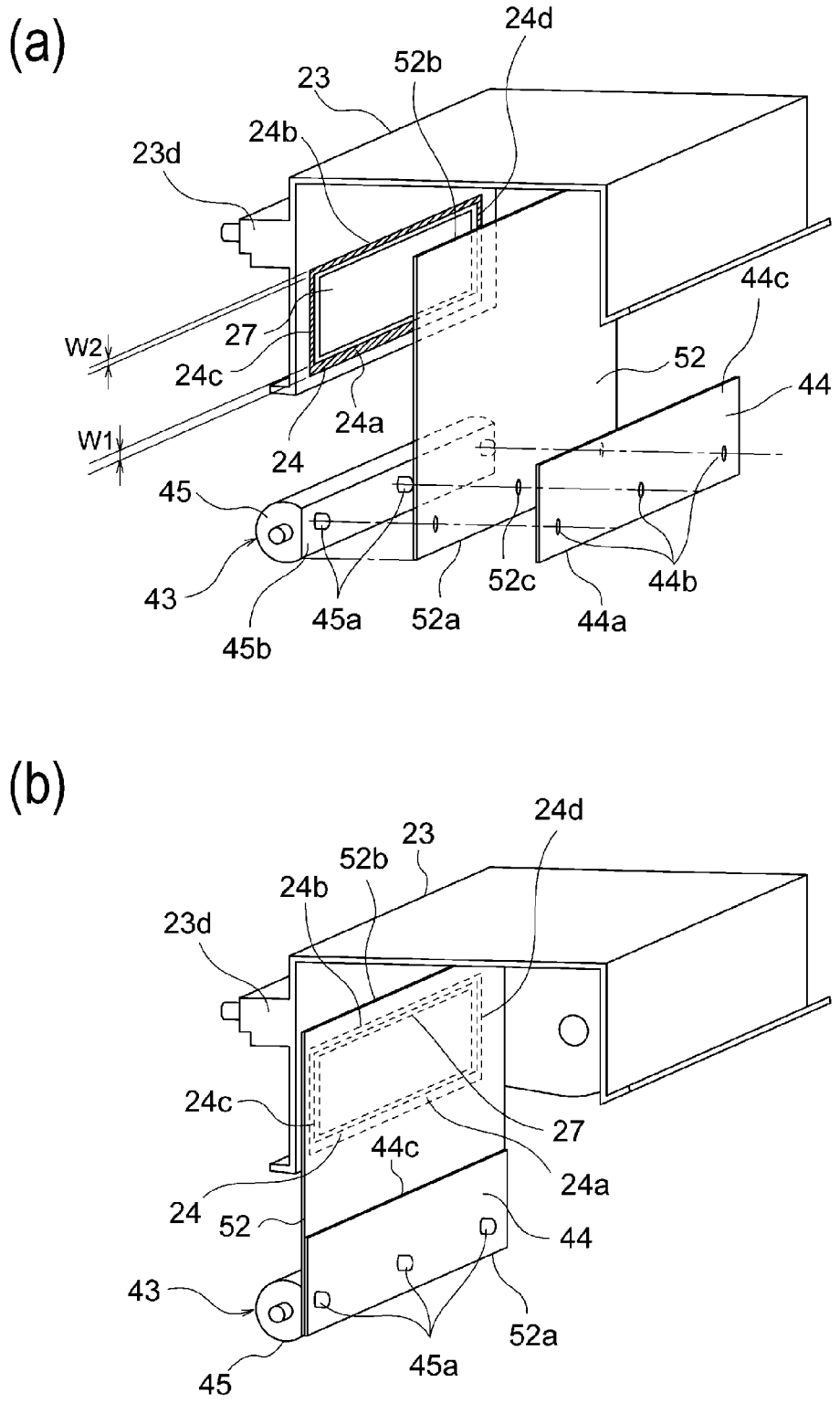
In FIG. 6, (a) and (b) are an exploded perspective view and a perspective illustration, respectively, showing a structure of first and second bonding portions of a sealing member.
Figure 7:
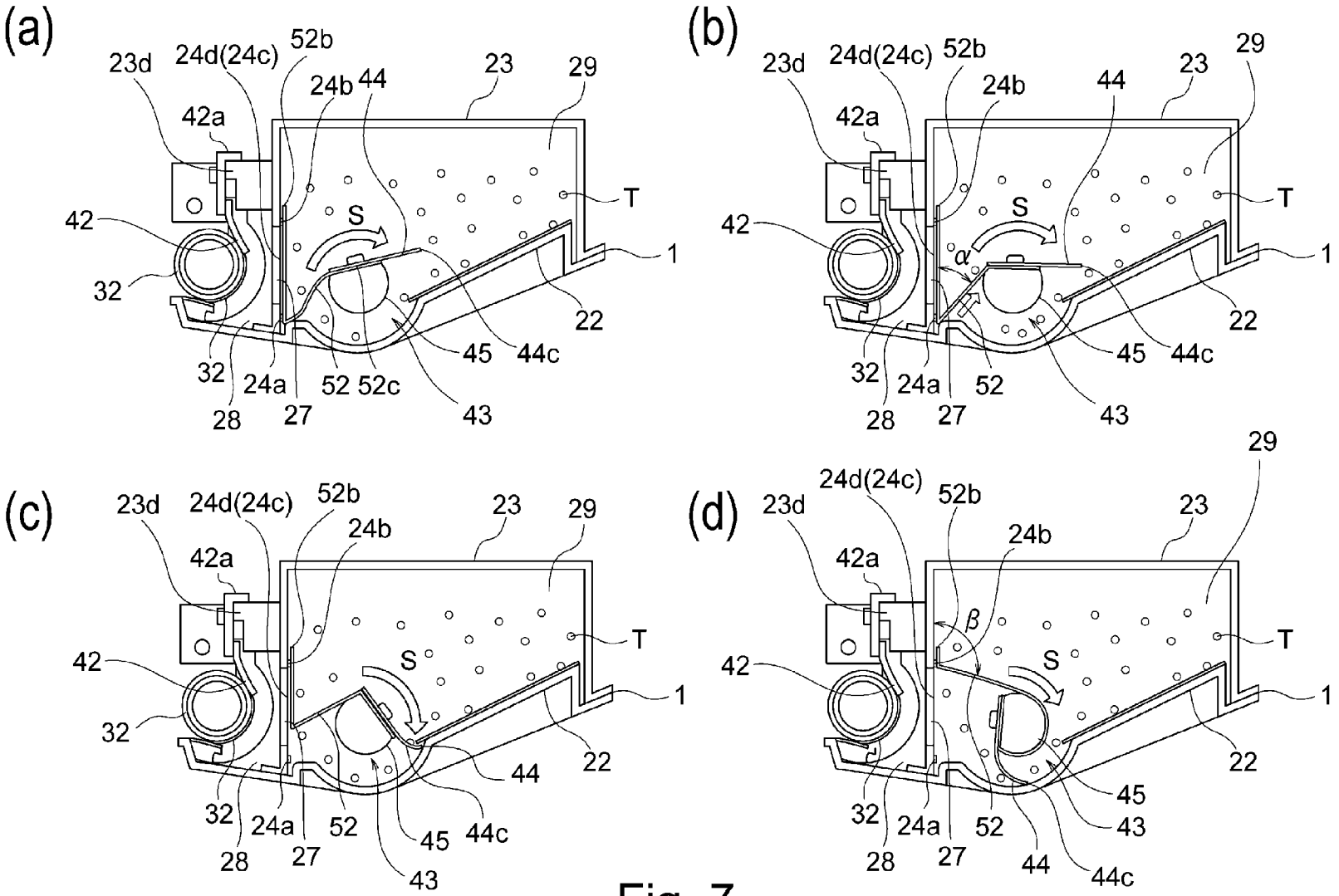
In FIG. 7, (a) to (d) are sectional illustrations showing a state in which an opening is unsealed (exposed) by winding up a sealing member by rotation of a rotatable member.

Next, with reference to FIGS. 6 and 7, a structure of the toner seal member 52 as the sealing member for sealing the opening 27 will be described. In FIG. 6, (a) and (b) are perspective views for illustrating a structure of a bonding portion of the toner seal member 52. FIG. 7 is a sectional illustration for explaining an unsealing operation of the toner seal member 52. As shown in (a) of FIG. 6, the upper container 23 is provided with the opening 27 for establishing communication between the toner chamber 29 shown in FIG. 7 and the toner supplying chamber 28.

The toner seal member 52 is constituted by a material compatible with a material for the upper container 23 or a material including an adhesive layer. The toner seal member 52 is provided in the toner chamber 29 (developer chamber), and includes an end portion 52*a* as a first end portion to be connected to the rotatable member 45 and an end portion 52*b* as a second end portion for sealing the opening 27. Further, with rotation of the rotatable member 45, the toner seal member 52 is wound up by the rotatable member 45 to unseal (expose) the opening 27.

Further, outside the toner seal member 52 of the rotatable member 45, the feeding sheet 44 is mounted. The feeding sheet 44 fixed on the rotatable member 45 can be formed of a flexible material such as polyethylene terephthalate (PET), polycarbonate (PC) or polyphenylene sulfide (PPS).

The end portion 52*a* of the toner seal member 52 in a mounted side to the rotatable member 45 and an end portion 44*a* of the feeding sheet 44 are provided with a plurality of holes 52*c* and a plurality of holes 44*b*, respectively. The rotatable member 45 is constituted by a D-shape in cross section, and a flat surface 45*c* of the rotatable member 45 is provided with a plurality of projections 45*a*. Then, with the projections 45*a* of the rotatable member 45, the through holes 52*a* of the toner seal member 52 and the through holes 44*b* of the feeding sheet 44 are successively engaged.

Thereafter, by thermally caulking the projections 45*a* of the rotatable member 45, the toner seal member 52, the feeding sheet 44 and the rotatable member 45 are integrally constituted. Here, a method of integrally assembling the toner seal member 32, the feeding sheet 44 and the rotatable member 45 may also be another integrally assembling method using welding, snap-fitting, double-side tape or the like, and is not necessarily limited.

The toner seal member 52 covers the opening 27, formed in the upper container 23, from the toner chamber 29 side, and is configured to have a mountable length to the rotatable member 45.

Further, as shown in FIG. 3, the toner seal member 52 is removed by rotating the rotatable member 45. Thereafter, a mounting position between the feeding sheet 44 and the toner seal member 52 is set so that the end portion 52*b* as an end of the toner seal member 52 does not extend over the end portion 44*c* as an end of the feeding sheet 44.

As shown in (b) of FIG. 6, sealing of the opening 27 formed in the upper container 23 is made by bonding the toner seal member 52 along an edge of the opening 27.

As seen from the opening 27 side, a welded portion 24*a* as a first bonding portion provided in an upstream side of the toner seal member 52 with respect to the unsealing direction (i.e., in a lower side of (b) of FIG. 6) is provided. Further, a welded portion 24*b* as a second bonding portion provided in a downstream of the welded portion 24*a* with respect to the unsealing (removal) direction of the toner seal member 52 (i.e., in an upper side of (b) of FIG. 6) is provided. Each of the welded portions 24*a* and 24*b* is provided in a long-side side of the opening 27.

A bonding width W1 of the welded portion 24*a* with respect to the unsealing direction (up-down direction of (b) of FIG. 6) of the toner seal member 52 is set so as to be larger than a bonding width W2 of the welded portion 24*b* with respect to the unsealing direction of the toner seal member 52. As a result, a peeling-off force for peeling off the toner seal member 52 at a predetermined angle by rotating the rotatable member 45 is set so as to be larger at the welded portion 24*a* than at the welded portion 24*b*.

Each of the welded portions 24*a* and 24*b* is formed in a rectilinear shape. As shown in (b) and (d) of FIG. 7, the toner seal member 52 is bonded along the edge of the opening 27 formed in the upper container 23 is peeled off. An unsealing (removal) angle of the toner seal member 52 with respect to a plane parallel to the opening 27 at that time is set so that an unsealing angle $\alpha$ at the welded portion 24*a* is smaller than an unsealing angle $\beta$ at the welded portion 24*b*.

The end portion 52*b* of the toner seal member 52 is positionally aligned so as to cover the opening 27 along the edge of the opening 27 formed in the upper container 23. Then, an unshown welding horn heated at a certain temperature is pressed against the toner seal member 52 from the toner chamber 29 side, so that the toner seal member 52 and the upper container 23 are thermally welded to form a rectangular continuous welded portion 24.

Here, the welded portion 24 is formed by including the welded portions 24*a* and 24*b* along the longitudinal direction of the opening 27 and welded portions 24*c* and 24*d* along a short (widthwise) direction of the opening 27, and the welded portions 24*a* to 24*d* are continuously formed. As a result, it becomes possible to seal (confine) the toner T in the toner chamber 29.

As shown in FIG. 6, the welded portion 24*b* is positioned in the developing blade 42 side as seen from the opening 27. At a position where the welded portion 24*b* is provided, a supporting portion 23*d* for the developing blade 42 for regulating a layer thickness of the toner T carried on the surface of the developing sleeve 32 for supplying the toner T to the surface of the photosensitive drum 62 on which the electrostatic latent image is formed is provided. The supporting portion 23*d* for the developing blade 42 constitutes a thick portion of the upper container 23. For this reason, rigidity of a portion where the welded portion 24*a* is provided is lower than that of a portion where the welded portion 24*b* is provided.

The welded portion 24*a* is positioned in the upstream side (lower side of (b) of FIG. 6) of the toner seal member 52 with respect to the unsealing direction of the toner seal member 52. The welded portion 24*c* is positioned in the non-driving side shown as the left side of FIG. 6, and the welded portion 24*d* is positioned in the driving side shown as the right side of FIG. 6.

In this embodiment, the bonding width W2 of each of the welded portions 24*b* to 24*d* is set at 1 mm, and the bonding width W1 of the welded portion 24*a* is set at 2 mm. Further, a welding temperature of each of the welded portions 24*a* to 24*d* is about 140° C. Incidentally, the values of the bonding widths W1 and W2 and the welding temperature are examples and therefore the scope of the present invention is not limited thereto.

As shown in (a) of FIG. 7, the toner seal member 52 is loosen between the welding portion 24*a* for the toner seal member 52 and the holes 52*c* thereof engaged with projections 45*a* of the rotatable member 45. As a result, even when an external force acts on the rotatable member 45 during assembling and transportation of the cartridge B, the toner seal member 52 is partly loosened and therefore tension is not applied to the toner seal member 52, and therefore a sealing force by the welding portion 24 for the toner seal member 52 can be maintained.

<Removing Operation of Toner Seal Member>

Next, a removing operation of the toner seal member 52 performed at the time of start of use of the cartridge B will be described with reference to FIGS. 3 and 7. The cartridge B is mounted in the main assembly of the image forming apparatus A, and the rotatable member 45 receives the driving force from an unshown driving source provided in the main assembly of the image forming apparatus A. Then, the rotatable member 45 is rotated in an arrow S direction of (a) of FIG. 7.

As shown in (a) of FIG. 7, when the rotatable member 45 is rotated in the arrow S direction, the toner seal member 52 is wound around the outer peripheral surface of the rotatable member 45, and then as shown in (b) of FIG. 7, tension is applied to the toner seal member 52. Further, when the rotatable member 45 is further rotated in the arrow S direction of FIG. 7, as shown in (c) and (d) of FIG. 7 the toner seal member 52 is peeled off in the order of the welded portion 24*a*, the welded portions 24*c* and 24*d*, and the welded portion 24*b*. As a result, as shown in FIG. 3, the opening 27 is unsealed (exposed), and then the toner T is supplied from the toner chamber 29 to the toner supplying chamber 28 by the feeding member 43.

<Load During Winding-Up of Toner Seal Member>

A load when the rotatable member 45 is rotated to wind up the toner seal member 52 will be described. As shown in (b) of FIG. 7, an unsealing angle at which the toner seal member 52 is wound up and peeled off by the rotatable member 45 at the welded portion 24*a* is a. As shown in (d) of FIG. 7, an unsealing angle at which the toner seal member 52 is wound up and peeled off by the rotatable member 45 at the welded portion 24*b* is β.

In general, the load during the winding-up of the toner seal member 52 by rotating the rotatable member 45 is small when the unsealing angle during the winding-up is small. For that reason, the peeling-off force for peeling off the toner seal member 52 at the welded portion 24*b* at the unsealing angle β as shown in (d) of FIG. 7 is higher than the peeling-off force for peeling off the toner seal member 52 at the welded portion 24*a* at the unsealing angle α as shown in (b) of FIG. 7.

For this reason, in the case where the load when the toner seal member 52 is wound up by the rotatable member 45 is set equally at the welded portions 24*a* and 24*b*, the peeling-off force at the welded portion 24*a* can be made smaller than the peeling-off force at the welded portion 24*b*. Here, the peeling-off force at each of the welded portions 24*a* and 24*b* is a force for peeling off the welded toner seal member 52 at a predetermined angle.

Figure 8:
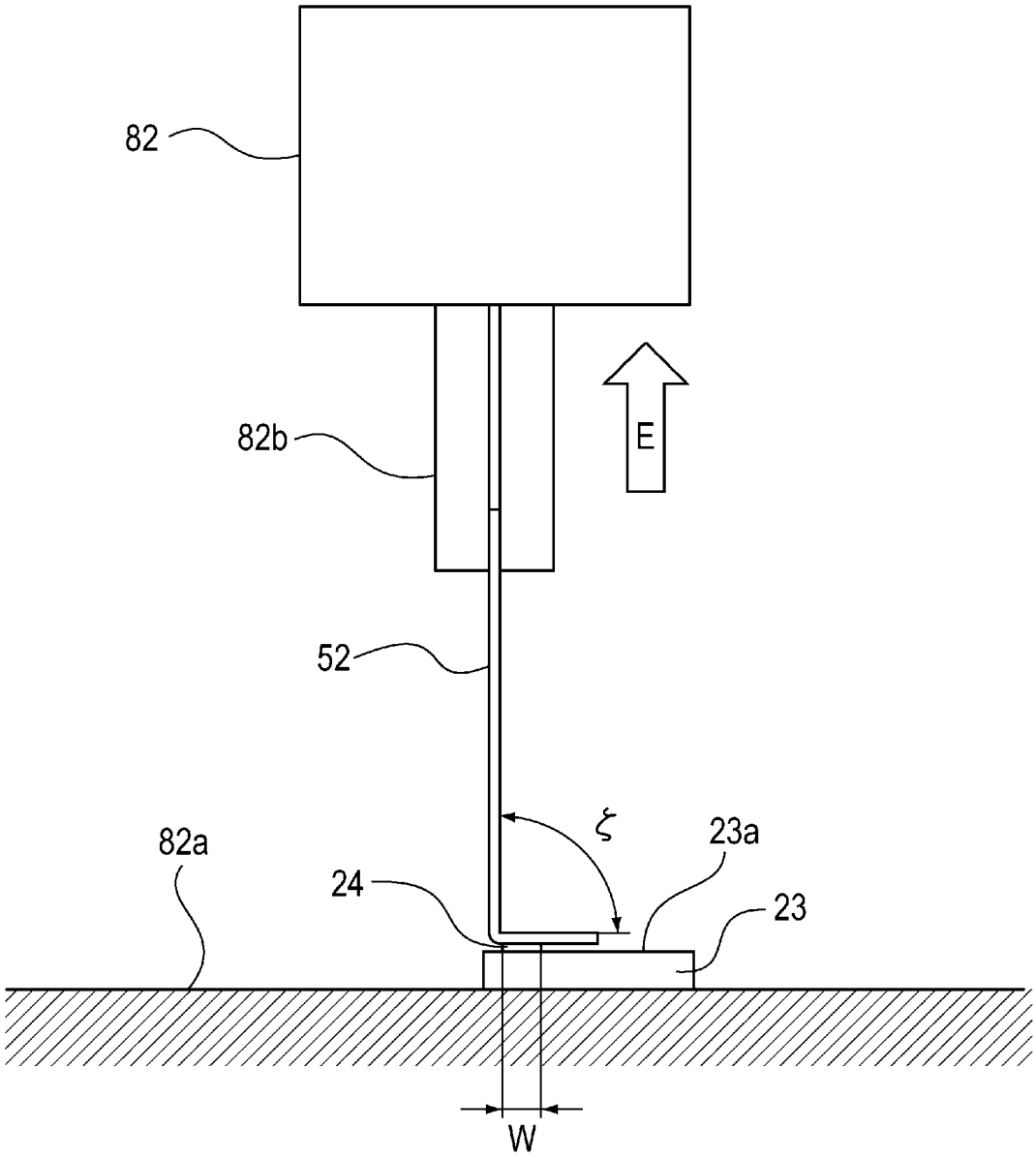
FIG. 8 is an illustration for explaining a measuring method of a peeling-off force of a toner seal member.

Further, a measuring method of the peeling-off force is as follows. FIG. 8 is a schematic view for illustrating the measuring method of the peeling-off force for peeling off the toner seal member 52. As shown in FIG. 8, the toner seal members 52 used as test pieces were formed in the same length, and an end of each of the toner seal members 52 was bonded to a bonding surface 23*a* of the upper container 23 via the welded portion 24. The upper container 23 cut away in a certain length was used.

The measurement of the peeling-off force of the toner seal member 52 is made by using a tensile (pulling) force testing machine 82. Mounting of the toner seal member 52, as the test piece, in the testing machine 82 is performed by fixing the cut-away upper container 23 on a base portion 82*a* of the testing machine 82 with an unshown screw or the like and then by sandwiching the toner seal member 52 by a chucking 82*b* of the testing machine 82. A tensile, angle ζ of the toner seal member 52 is an angle of the upper container 23 with respect to the bonding surface 23*a*.

Figure 9:
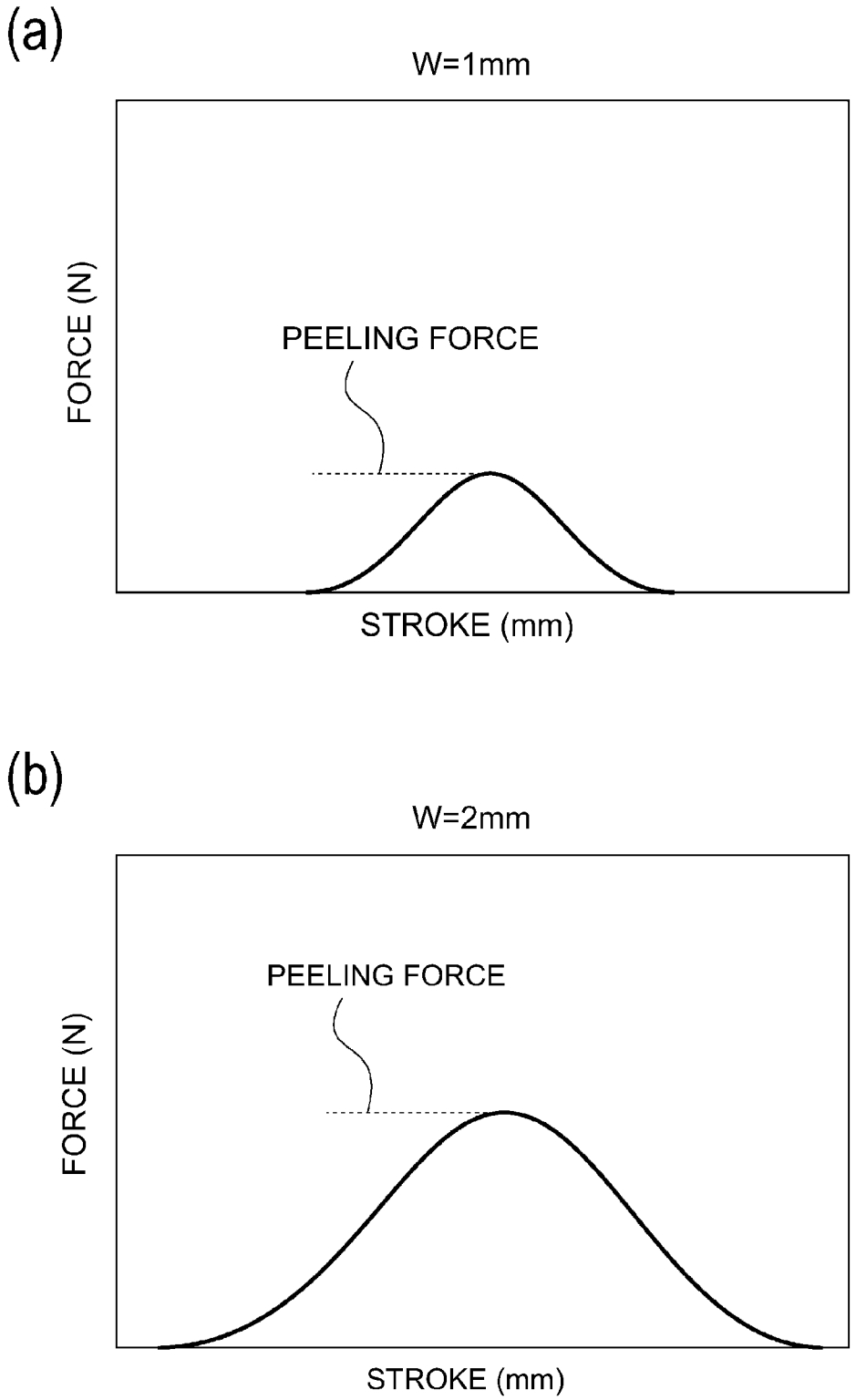
In FIG. 9, (a) and (b) are measurement results of the peeling-off force when the toner seal member is peeled off from an upper container.

As shown in (a) and (b) of FIG. 9, the measurement of the peeling-off force at the welded portion 24 by the testing machine 82 is made by pulling the toner seal member 52 in the arrow E direction of FIG. 8 at the same speed and the same angle ζ. Further, a profile of a force when the toner seal member 52 is pulled in the direction of the angle ζ at the same speed is provided. A maximum of this profile is taken as the peeling-off force.

The toner seal members 52, as the test piece shown in FIG. 8, for which the bonding widths W of the welded portion 24 where ends of the toner seal members 52 are welded are 1 mm and 2 mm, a length of the welded portion 24 with respect to a depth direction of the drawing sheet of FIG. 8 is 15 mm, and the tensile angle ζ is 90 degrees are used. Further, a measurement result of the peeling-off force when the toner seal member 52 is peeled off at the welded portion 24 by the testing machine 82 is shown in each of (a) and (b) of FIG. 9.

As shown in (a) and (b) of FIG. 9, the peeling-off force when the toner seal member 52 bonded via the welded portion 24 onto the bonding surface 23*a* of the upper container 23 is peeled off at the same angle ζ is as follows. The peeling-off force became larger in proportional to a value of the bonding width W of the welded portion 24, and when the bonding width W was doubled, also the peeling-off force was approximately doubled. Therefore, in this embodiment, as shown in (a) of FIG. 6, by providing a difference between the bonding widths W1 and W2 of the welded portions 24*a* and 24*b*, so that a difference in peeling-off force is provided.

<Transportation Test of Cartridge>

Figure 10:
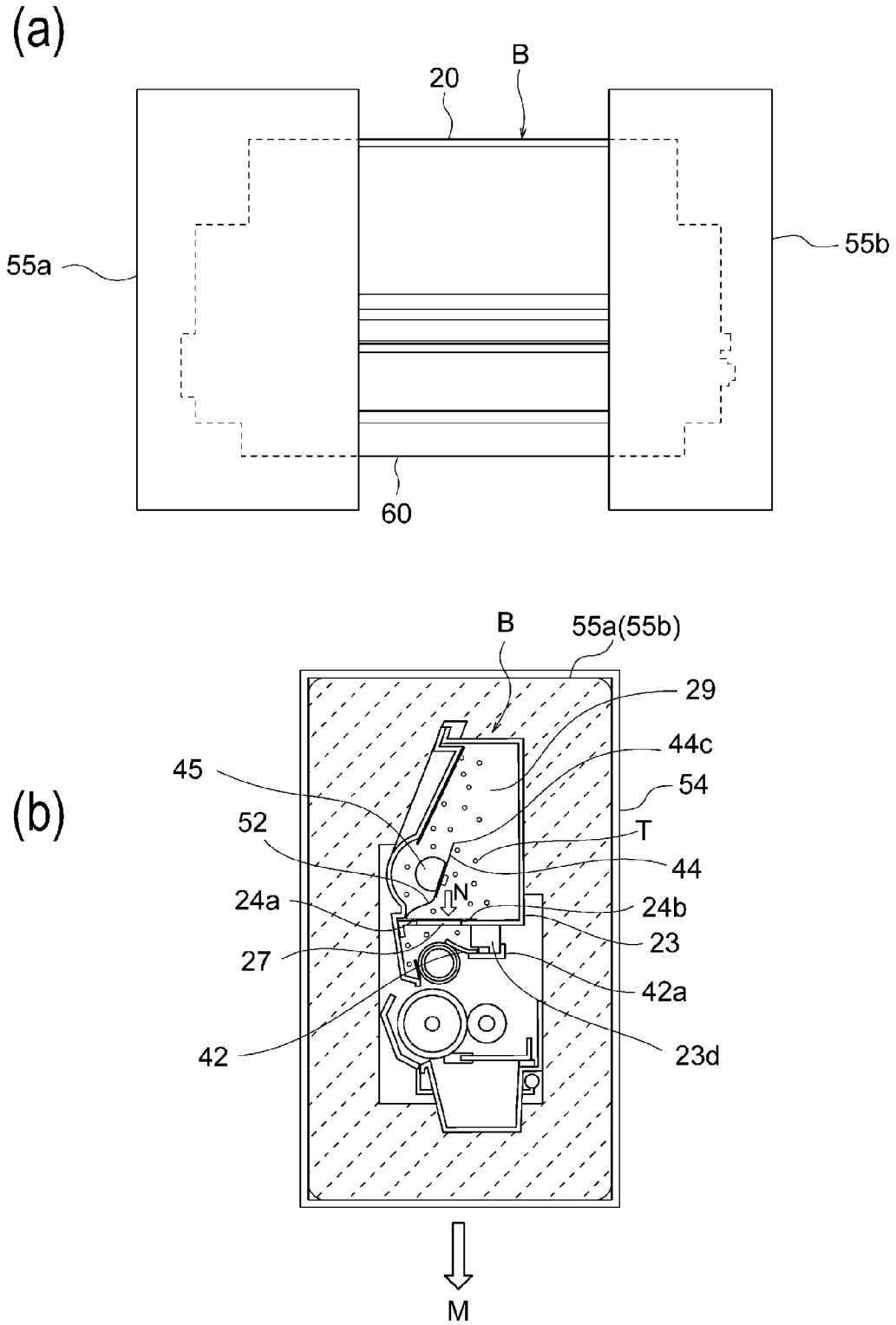
In FIG. 10, (a) and (b) are a plan view and a sectional illustration, respectively, showing a state in which the process cartridge according to the present invention is packed.
Figure 11:
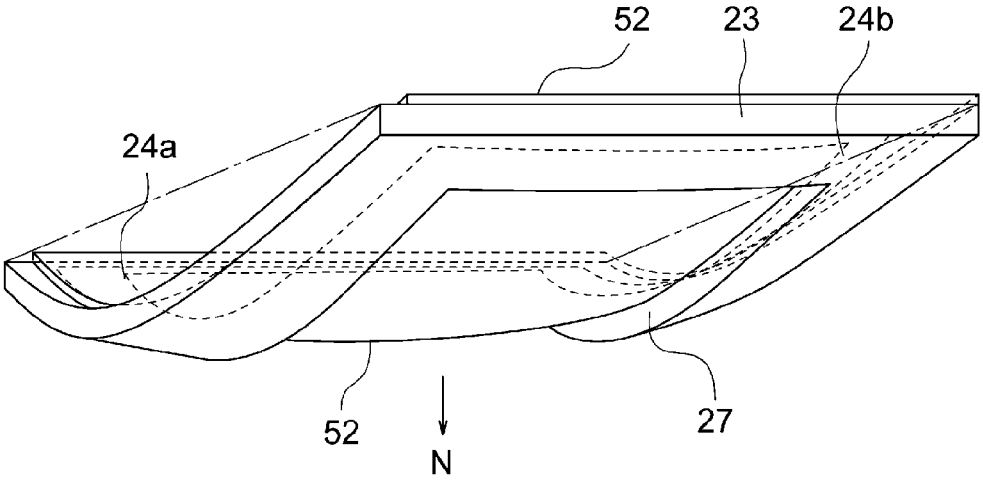
In FIG. 11, (a) and (b) are a perspective illustration and a sectional illustration, respectively, for explaining deformation of a periphery of the opening of the developer container.
Figure 11:
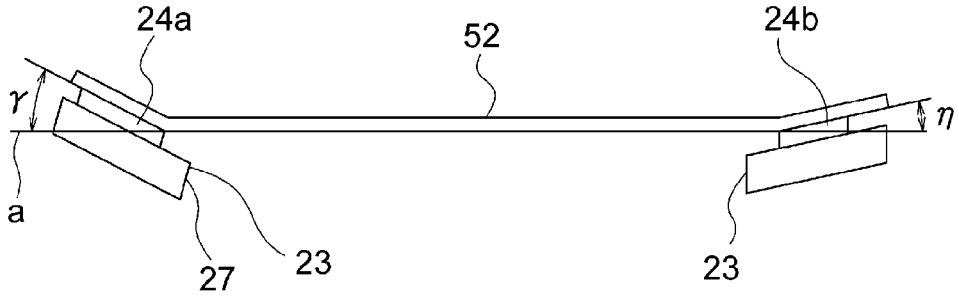

A transportation test of the cartridge B will be described with reference to FIGS. 10 and 11. In FIG. 10, (a) is a plan view for illustrating a packed state of the cartridge B, and (b) is a sectional view for illustrating the packed state of the cartridge B. In FIG. 11, (a) is a perspective view for illustrating deformation at a periphery of the opening 27 of the upper container 23 when the transportation test is conducted, and (b) is a sectional view for illustrating the deformation at the periphery of the opening 27 of the upper container 23 when the transportation test is conducted.

As shown in (a) and (b) of FIG. 10, during the transportation of the cartridge B, the cartridge B is supported, at longitudinal end portions thereof, by cushioning materials 55*a* and 55*b*, such as a pipe, corrugated cardboard or styrofoam, having cushioning power, and then is packed in a packing box.

During the transportation of the cartridge B, (b) of FIG. 10 shows an attitude in which the weight of the toner T accommodated in the toner chamber 29 is exerted on the toner seal member 52. In the attitude shown in (b) of FIG. 10, the cartridge B is caused to fall in an arrow M direction shown in (b) of FIG. 10. Then, by the weight of the toner T, the toner seal member 52 is pressed in an arrow N direction shown in (b) of FIG. 10, so that a periphery of the opening 27 of the upper container 23 is deformed as shown in (a) of FIG. 11.

As shown in FIG. 6, the welded portion 24*b* has higher rigidity than the welded portion 24*a* by the presence of the supporting portion 23*a* for supporting the developing blade 42. For this reason, an amount of the deformation at the welded portion 24*b* shown in the right side of each of (a) and (b) of FIG. 11 is smaller than an amount of deformation at the welded portion 24*a* shown in the left side of each of (a) and (b) of FIG. 11. As a result, a shearing force exerted on the welded portion 24*b* is smaller than a shearing force exerted on the welded portion 21*a*. Accordingly, when the peeling-off forces at the welded portions 24*a* and 24*b* are the same, the toner seal member 52 is less peeled off from the upper container 23 at the welded portion 24*b* than at the welded portion 24*a*.

Further, as shown in (b) of FIG. 11, the weight of the toner T is exerted on the toner seal member 52, so that the periphery of the opening 27 of the upper container 23 is deformed. By the deformation, an angle $\eta$ of a plane of the welded portion 24*b* of the upper container 23 with respect to a plane a of the toner seal member 52 in a state in which the toner seal member 52 is stretched while opposing the opening 27 connecting the welded portions 24*a* and 24*b* is as follows. That is, the angle $\eta$ is smaller than an angle $\gamma$ of a plane of the welded portion 24*a* of the developer container 23 with respect to the plane a of the toner seal member 52.

As a result, when the peeling-off forces at the welded portions 24*a* and 24*b* are the same, the toner seal member 52 is less peeled off from the upper container 23 at the welded portion 24*b* than at the welded portion 24*a*.

In this embodiment, the bonding widths are set by being changed so that the peeling-off force at the welded portion 24*a* is larger than the peeling-off force at the welded portion 24*b*. Further, even in the case where the weight of the toner T is exerted on the toner seal member 52 to cause the deformation of the periphery of the opening 27 of the upper container 23, the toner seal member 52 is not readily peeled off from the upper container 23. Incidentally, it is also possible to change the peeling-off force by changing a type of the adhesive.

As a result, during the transportation of the cartridge B, shock resistance of the toner seal member 52 against the peeling from the upper container 23 at the welded portion 24*a* is equal to the shock resistance at the welded portion 24*b*.

Figure 12:
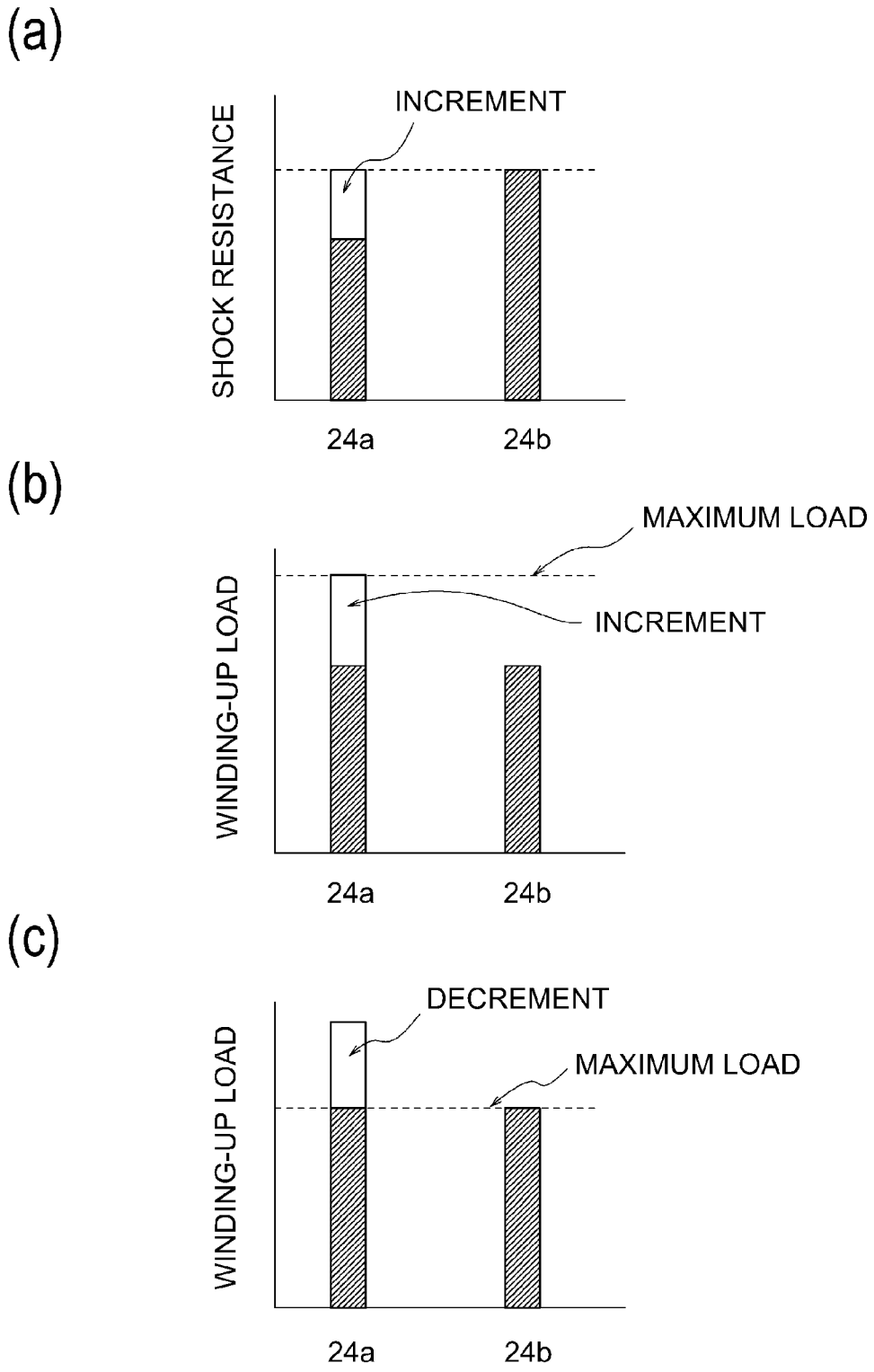
In FIG. 12, (a) to (c) are graphs for illustrating loads at the time of peeling off the first and second bonding portions.

According to this embodiment, as shown in (a) of FIG. 12, the peeling-off force of the toner seal member 52 from the upper container 23 at the welded portion 24*a* weak with respect to the drop of the cartridge B during the transportation is made high. As a result, the shock resistance against the peeling of the toner seal member 52 from the upper container 23 is improved.

Further, as shown in (a) of FIG. 12, a winding-up load of the toner seal member 52 by the rotatable member 45 is increased. On the other hand, as shown in (a) and (b) of FIG. 7, the unsealing angle $\alpha$ at the welded portion 24*a* is made smaller than the unsealing angle $\beta$ at the welded portion 24*b*. As a result, as shown in (c) of FIG. 12, the winding-up load at the welded portion 24*a* during the winding-up of the toner seal member 52 by the rotatable member 45 is lowered. As a result, it is possible to improve the shock resistance against the peeling-off of the toner seal member 52 from the upper container 23 during the transportation of the cartridge B without increasing a winding-up maximum load of the toner seal member 52 wound up by the rotatable member 45.

Figure 13:
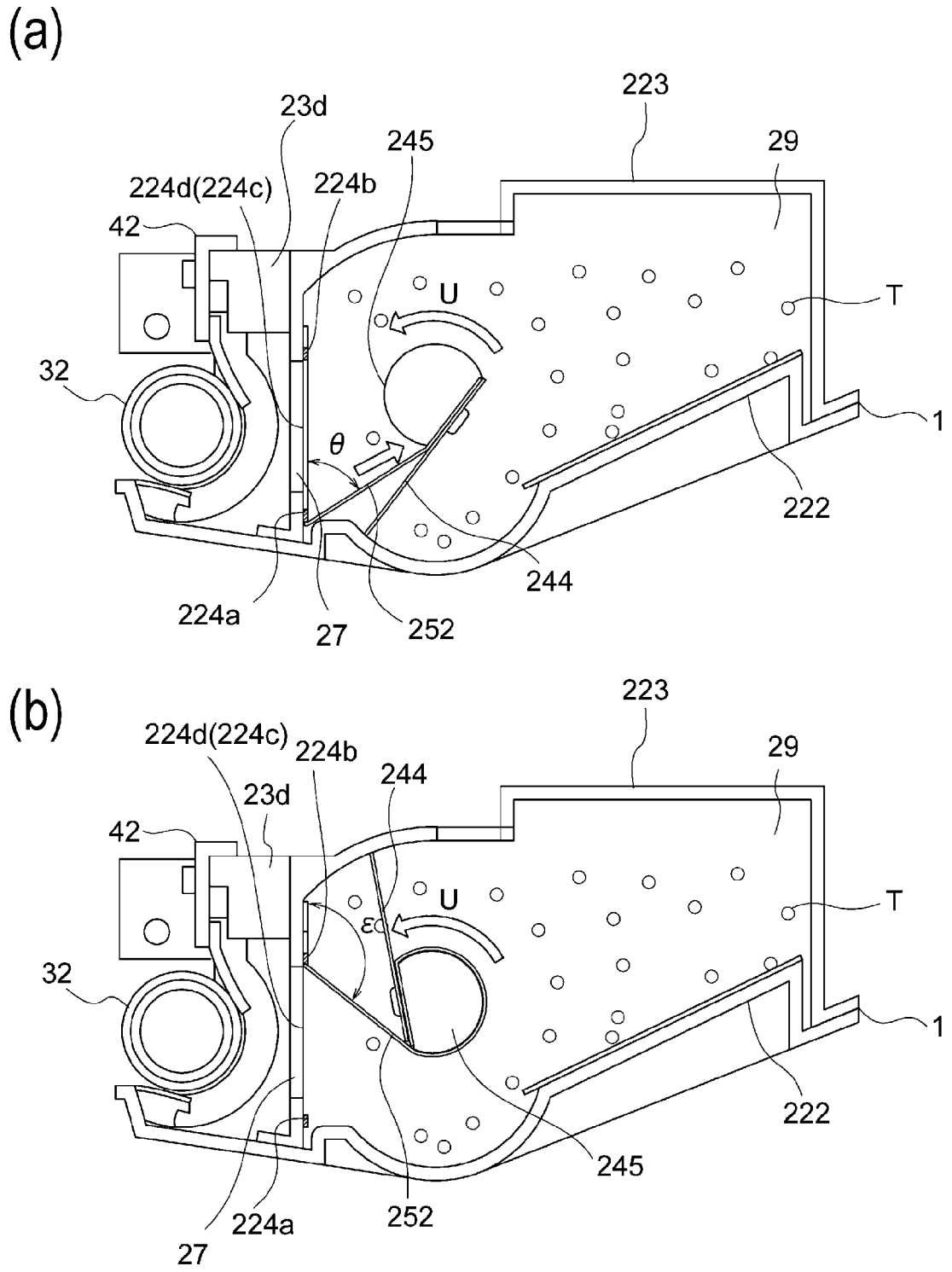
In FIG. 13, (a) and (b) are sectional illustrations showing another structure in which the opening is unsealed by winding up the sealing member by reverse rotation of the rotatable member.

Incidentally, in this embodiment, as shown in FIG. 7, the rotational direction of the rotatable member 45 is set in the arrow S direction in FIG. 7, but as another constitution as shown in FIG. 13, the rotational direction of a rotatable member 245 may also be an arrow U direction, of FIG. 13, opposite to the arrow S direction of FIG. 7.

The rotational direction of the rotatable member 245 rotatably supported in the toner chamber 29 is the arrow U direction of FIG. 13.

Also in that case, as seen from the opening 27 side, an unsealing angle $\theta$ of a welded portion 224*a* as a first bonding portion provided in the upstream side of the toner seal member 252 with respect to the unsealing direction (i.e., in the lower side of (b) of FIG. 13) is as follows. That is, a relationship such that the unsealing angle $\theta$ is smaller than an unsealing angle $\epsilon$ at a welded portion 224*b* as a second bonding portion provided in a downstream of the welded portion 224*a* with respect to the unsealing direction of the toner seal member 252 (i.e., in an upper side of (b) of FIG. 13) is the same as that in the embodiment shown in FIG. 7. As a result, a winding-up load of the toner seal member 252 by a rotatable member 245 is lower at the welded portion 224*a* than at the welded portion 224*b*.

Further, a bonding width of the welded portion 224*a* with respect to the unsealing direction (up-down direction of (b) of FIG. 13) of the toner seal member 252 is set so as to be larger than a bonding width of the welded portion 224*b* with respect to the unsealing direction of the toner seal member 252. As a result, shock resistance against the peeling-off of the toner seal member 252 from the upper container 223 at the welded portion 224*a* during the transportation of the cartridge B is improved. Accordingly, an effect similar to the above-described effect can be obtained without increasing a maximum winding-up load of the toner seal member 252 by the rotatable member 245.

According to each of the above-described constitutions, the maximum load when the toner seal member 52 or 252 which seals the opening 27 is wound up by the rotatable member 45 or 245 is prevented from being increased. Further, also in the case where the weight of the developer is further increased, during the transportation, the peeling-off of the toner seal member 52 or 252 is prevented.

Further, without increasing the maximum load during the removal of the toner seal member 52 or 252, it is possible to prevent the toner seal member 52 or 252 from being peeled off also with respect to larger shock during the transportation. As a result, the cushioning material for packing the developing unit 20 can be further downsized and thus an outer configuration of the packing can also be further downsized, so that transportation efficiency can be improved to reduce a cost.

Incidentally, in FIG. 13, a welded portion 224 further includes widthwise (short) welded portions 224*c* and 224*d*, and an upper container 223, a bottom member 224 and a feeding sheet 244 are shown.

Incidentally, constituent elements similar to those in the embodiments described above are represented by the same or different reference numerals or symbols and will be omitted from description. Other constitutions are the same as those in the embodiments described above, and a similar effect can be obtained.

Incidentally, in each of the above-described embodiments, the difference in peeling-off force is provided depending on the value of the bonding width of the welded portion, but it is also possible to provide the difference also by using the same bonding width of the welded portion and by providing a difference in welding temperature or welding pressure during the welding, so that a similar effect can be obtained.

Further, the toner seal member can also be mounted on the upper container by a method, other than the welding, such as bond using a double-side tape, hot-melt or an adhesive. Also by providing a difference in adhesive force of each of these materials, the difference in peeling-off force can be provided, so that a similar effect can be obtained.

Further, functions, materials, shapes and relative arrangement of constituent elements described in the above-mentioned embodiments do not limit the scope of the present invention thereto unless otherwise specified.

Incidentally, a constitution in which a developing cartridge prepared by integrally assembling at least the toner chamber 29 and the developing sleeve 32 with the developing unit 20 as the developer container is detachably mountable to the main assembly of the image forming apparatus A may also be employed.

The peeling-off forces at the bonding portions are made different from each other, whereby it is possible to prevent the sealing member from being peeled off even against larger shock during transportation or the like.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 108522/2013 filed May 23, 2013 and 042843/2014 filed Mar. 5, 2014, which are hereby incorporated by reference.

What is claimed is:

1. A developer container comprising:

a developer chamber, provided with an opening, for accommodating developer;

a rotatable member rotatably supported in said developer chamber; and a sealing member for being removed at the opening by being wound up by said rotatable member, said sealing member being provided in said developer chamber and including a first end portion connected to said rotatable member and a second end portion sealing the opening, wherein the opening is sealed by bonding said sealing member along an edge of the opening, wherein said developer container includes a first bonding portion provided upstream of the opening and a second bonding portion provided downstream of the opening with respect to an unsealing direction of said sealing member, and wherein a peeling-off force for peeling off said sealing member at a predetermined angle is larger at said first bonding portion than at said second bonding portion.

2. A developer container according to claim 1, wherein a bonding width of said first bonding portion with respect to the unsealing direction of said sealing member is larger than a bonding width of said second bonding portion with respect to the unsealing direction of said sealing member.

3. A developer container according to claim 1, wherein rigidity of said developer container at a position where said first bonding portion is provided is less than rigidity of said developer container at a position where said second bonding portion is provided.

4. A developer container according to claim 1, wherein at a position where said second bonding portion of said developer container is provided, a supporting portion of a developer regulating member is provided for regulating a developer layer thickness of a developer carrying member for supplying the developer to a surface of an image bearing member on which an electrostatic latent image is to be formed.

5. A developer container according to claim 1, wherein an unsealing angle of said sealing member with respect to a plane parallel to the opening when said sealing member is bonded along the edge of the opening is smaller at said first bonding portion than at said second bonding portion.

6. A developer container according to claim 1, wherein each of said first bonding portion and said second bonding portion is formed in a rectilinear shape.

7. A developer container according to claim 1, wherein the opening is formed in a rectangular shape.

8. A developer container according to claim 1, wherein the opening is constituted by long sides and short sides, and wherein said first bonding portion is provided in a side of one of the long sides.

9. A developing cartridge comprising:

a developer container according to claim 1; and a developer carrying member for supplying the developer to a surface of an image bearing member.

10. A process cartridge comprising:

a developer container according to claim 1; and an image bearing member for forming a developer image with the developer.

11. An image forming apparatus for forming an image on a recording material, said image forming apparatus comprising:

a developer container according to claim 1 detachably mountable to said image forming apparatus.

12. A developer container comprising:

a developer chamber, provided with an opening, for accommodating developer; and a sealing member for being removed at the opening by being wound up by a rotatable member, said sealing member including a first end portion connected to said rotatable member and a second end portion sealing the opening, wherein the opening is sealed by bonding said sealing member along an edge of the opening, wherein said developer container includes a first bonding portion provided upstream of the opening and a second bonding portion provided downstream of the opening with respect to an unsealing direction of said sealing member, and wherein a bonding width of said first bonding portion with respect to the unsealing direction is larger than a bonding width of said second bonding portion with respect to the unsealing direction.

13. A developer container comprising:

a developer chamber, provided with an opening, for accommodating developer; and a sealing member for being removed at the opening by being wound up by a rotatable member, said sealing member including a first end portion connected to said rotatable member and a second end portion sealing the opening, wherein the opening is sealed by bonding said sealing member along an edge of the opening, wherein said developer container includes a first bonding portion provided upstream of the opening and a second bonding portion provided downstream of the opening with respect to an unsealing direction of said sealing member, and wherein rigidity of said developer container at a position where said first bonding portion is provided is less than rigidity of said developer container at a position where said second bonding portion is provided.

* * * * *